US006050785A

United States Patent [19]

Horng

[11] Patent Number: 6,050,785

[45] Date of Patent: Apr. 18, 2000

[54] AXLE BALANCE PLATES FOR MINIATURE HEAT DISSIPATING FAN ASSEMBLIES

[75] Inventor: Alex Horng, Kaohsiung, Taiwan

[73] Assignee: Sunonwealth Electric Machine Industry Co., Ltd., Kaohsiung, Taiwan

[21] Appl. No.: 09/185,584

[22] Filed: Nov. 4, 1998

[51] Int. Cl.[7] ..... F04B 17/03; H02K 29/08

[52] U.S. Cl. ..... 417/354; 417/423.14

[58] Field of Search ..... 417/354, 423.1, 417/423.14; 310/254; 318/254; 165/121, 122

[56] References Cited

U.S. PATENT DOCUMENTS

| | | | |
|---|---|---|---|
| 4,164,690 | 8/1979 | Muller et al. | 417/410.1 X |
| 5,699,854 | 12/1997 | Hong | 165/121 |
| 5,859,486 | 1/1999 | Nakahara et al. | 310/254 |
| 5,947,704 | 9/1999 | Hsieh | 417/423.14 |

*Primary Examiner*—Tony M. Argenbright

*Attorney, Agent, or Firm*—Stevens, Davis, Miller & Mosher, L.L.P.

[57] ABSTRACT

A miniature heat dissipating fan assembly includes a casing, a circuit board, a balance plate, a stator, a rotor, and a cover plate. The casing includes a compartment and an air outlet communicated with the compartment. A bottom wall that defines the compartment includes a tube seat formed thereon. The circuit board includes a fixing hole so as to be mounted around the tube seat. The balance plate also includes a fixing hole so as to be mounted around the tube seat. The stator includes an axle tube received in the tube seat, while the rotor includes an axle rotatably received in the axle tube, and a fastening member is provided to a distal end of the axle to retain the axle in place. The cover plate is attached to the casing and includes an air inlet. The balance plate is made of magnetic material and mounted below the rotor. A permanent magnet on the rotor and the balance plate attract each other to generate an attraction therebetween. This attraction creates a balancing force for assuring stable rotational movements of the rotor relative to the stator, thereby eliminating noise resulting from vibrations during rotation of the rotor.

16 Claims, 12 Drawing Sheets

AXLE BALANCE PLATES FOR MINIATURE HEAT DISSIPATING FAN ASSEMBLIES

BACKGROUND OF THE INVENTION

1. Field of the Invention

The present invention relates to miniature heat dissipating fan assemblies, and more particularly to miniature heat dissipating fan assemblies each having a balance plate for assuring stable rotational movement of the rotor axle.

2. Description of the Related Art

Taiwan Utility Model Patent Publication No. 316733 issued on Sep. 3, 1997, corresponding to U.S. Pat. No. 5,699,854, discloses a miniature heat dissipating fan assembly for outputting air in a certain direction. The fan assembly includes a base plate having a compartment with a helical channel and an air outlet. A tube seat is mounted in the compartment and includes an axle hole for rotatably receiving an axle tube of a coil seat. A coil on the coil seat generates magnetic fields to drive the fan to rotate. The fan includes a number of blades for sucking air into the fan assembly and outputting air via the outlet. A cover plate is provided to the base plate and includes an air inlet having a diameter smaller than that of the fan. The base plate includes a number of engaging notches, while the cover plate includes a number of corresponding inverted hooks for securely engaging with the engaging notches. Such miniature fan assembly has a relatively small thickness such that only one bearing can be used in the axle tube. As a result, the axle of the fan mounted in the axle tube tends to vibrate and/or slant. The present invention is intended to provide improved miniature fan assemblies to solve this problem.

SUMMARY OF THE INVENTION

It is a primary object of the present invention to provide an improved miniature heat dissipating fan assembly that includes a metallic balance plate mounted below the rotor. The balance plate and the permanent magnet mounted on the rotor attract each other to provide a magnetic balance to thereby assure stable rotational movements of the axle of the rotor. Thus, vibrations that may cause noise (resulting from impact of the blades on the rotor to the casing) and thus reduce the service life period can be eliminated by the balance between the permanent magnet and the balance plate.

It is another object of the present invention to provide a miniature heat dissipating fan assembly with a balance plate that can be easily assembled.

In accordance with the present invention, a miniature heat dissipating fan assembly includes a casing, a circuit board, a balance plate, a stator, a rotor, and a cover plate. The casing includes a compartment and an air outlet communicated with the compartment. A bottom wall that defines the compartment includes a tube seat formed thereon. The circuit board includes a fixing hole so as to be mounted around the tube seat. The balance plate also includes a fixing hole so as to be mounted around the tube seat. The balance plate further includes two notches. A Hall sensor mounted on the circuit board may be received in one of the notches. The stator includes an axle tube received in the tube seat, while the rotor includes an axle rotatably received in the axle tube, and a fastening member is provided to a distal end of the axle to retain the axle in place. The rotor further includes a permanent magnet mounted in an inner periphery thereof.

The permanent magnet and the balance plate attract each other to generate an attraction therebetween. This attraction assures stable rotational movements of the rotor relative to the stator. The cover plate is attached to the casing and includes an air inlet. Rotational movements of the rotor drive ambient air into the casing to carry away the heat in the casing via the air outlet.

In several embodiments of the invention, the present invention discloses a balance plate mounted around the tube seat, a balance plate with two positioning notches extended by positioning pegs of the stator, a balance plate with two positioning holes extended by positioning pegs of the stator, and a balance plate with two positioning holes extended by positioning pegs of the casing. All arrangements of the embodiments allow easy assembly and secure positioning effects among the elements.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
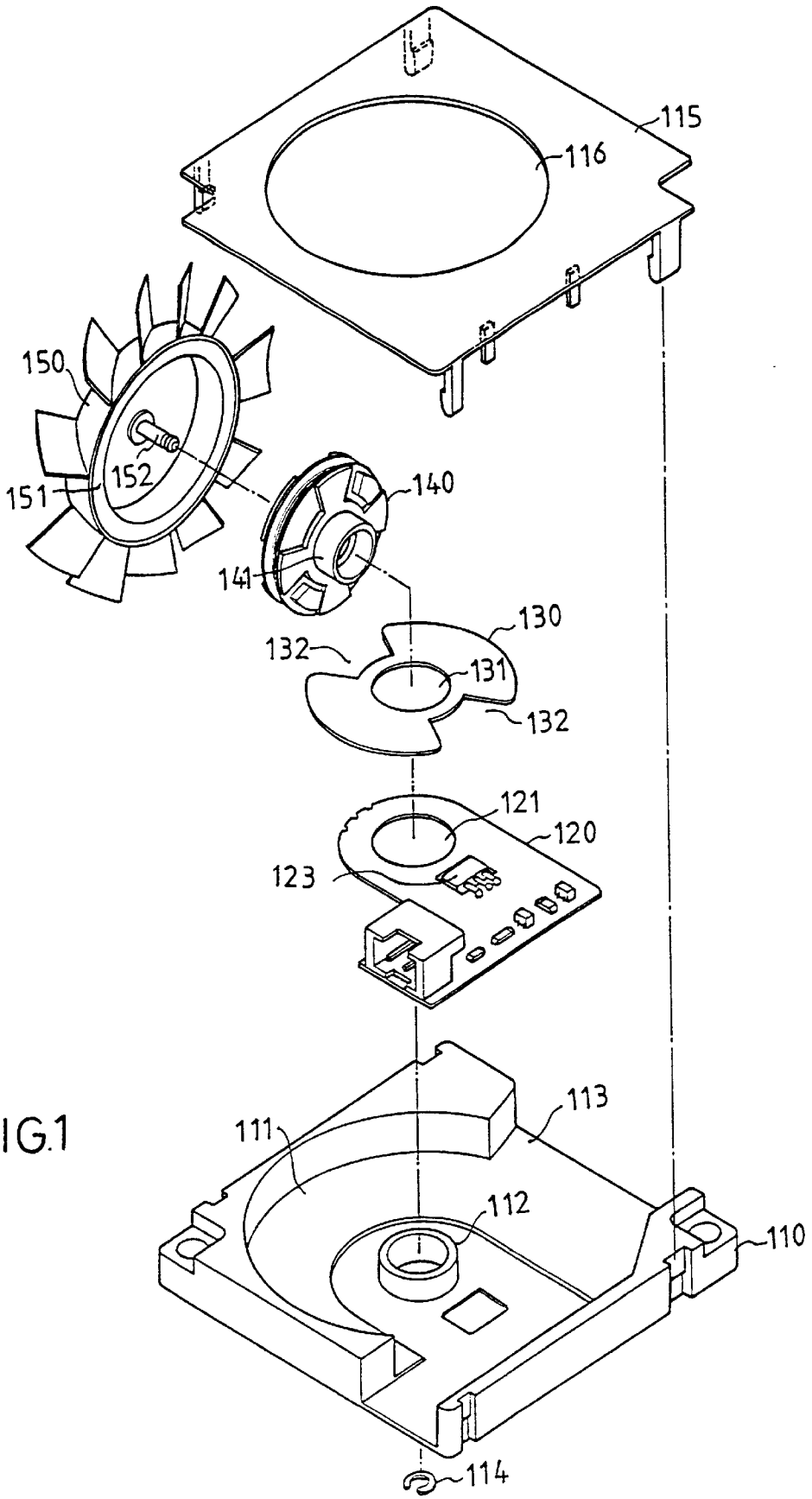
FIG. 1 is an exploded perspective view of a first embodiment of a miniature heat dissipating fan assembly in accordance with the present invention.
Figure 2:
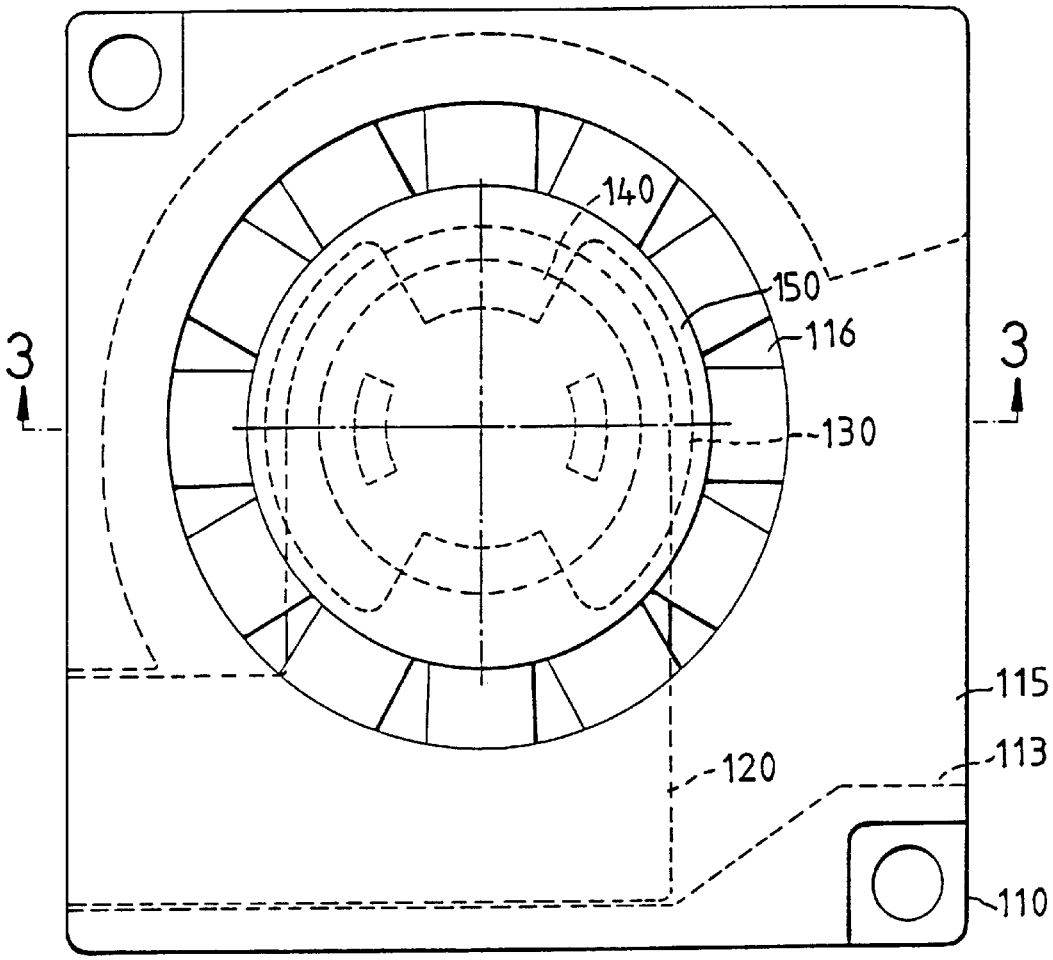
FIG. 2 is a top view of the miniature heat dissipating fan assembly in FIG. 1.
Figure 3:
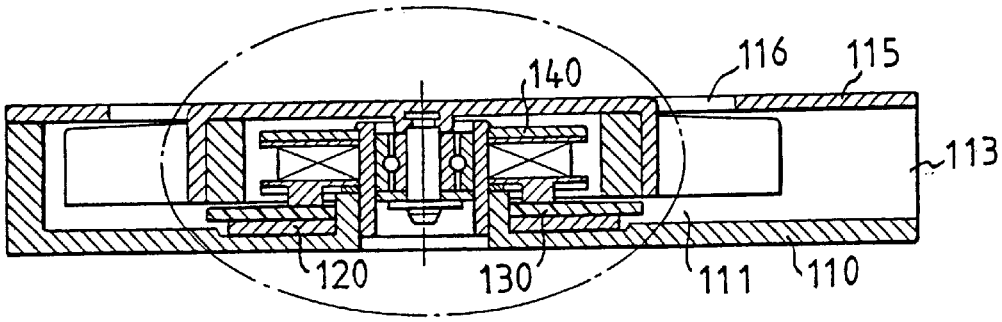
FIG. 3 is a sectional view taken along line 3—3 in FIG. 2.
Figure 4:
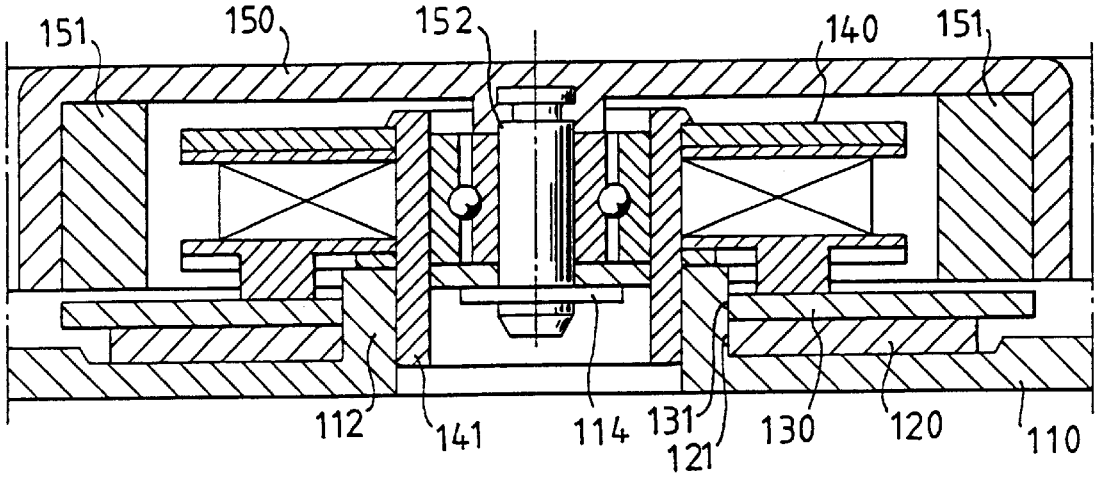
FIG. 4 is an enlarged view of a circle in FIG. 3.

Referring to FIG. 1, a first embodiment of a miniature heat dissipating fan assembly in accordance with the present invention generally includes a casing 110, a circuit board 120, a balance plate 130, a stator 140, a rotor 150, and a cover plate 115. Still referring to FIG. 1, and further to FIGS. 2 to 4, the casing 110 may be made of material with excellent conductivity and include a compartment 111 and an air outlet 113 communicated with the compartment 111. A bottom wall that defines the compartment 111 includes a tube seat 112 formed thereon. The circuit board 120 includes a fixing hole 121 so as to be mounted around the tube seat 112. The balance plate 130 is made of magnetic material or material with magnetic adherence. The balance plate 130 is mounted above the circuit board 120 and includes a fixing hole 131 so as to be mounted around the tube seat 112. The balance plate 130 may further include two notches 132 defined in a periphery thereof. A Hall sensor 123 mounted on the circuit board 120 may be received in one of the notches 132. The stator 140 includes an axle tube 141 received in the tube seat 112, while the rotor 150 includes an axle 152 rotatably received in the axle tube 141, and a fastening member 114 is provided to a distal end of the axle 152 to retain the axle 152 in place. The rotor 150 further includes a permanent magnet 151 mounted in an inner periphery thereof. A gap is defined between the balance plate 130 and the permanent magnet 151.

The permanent magnet 151 and the balance plate 130 attract each other. The balance plate 130 is configured symmetrically so as to generate a balancing attraction between the balance plate 130 and the permanent magnet 151. This attraction assures stable rotational movements of the rotor 150 relative to the stator 140. The cover plate 115 is attached to the casing 110 and includes an air inlet 116. Rotational movements of the rotor 150 drive ambient air into the casing 110 to carry away the heat in the casing 110 via the air outlet 113. Thus, heat dissipation is achieved by air convection.

Still referring to FIGS. 1 to 4, typically, the mass of the rotor 150 is not uniformly and symmetrically distributed such that the center of mass will rotate about the axle rod 152 during rotation of the rotor 150 relative to the stator 140. As mentioned in the background of the invention, the rotor 150 is supported on the stator 140 by only one bearing and thus tends to generate vibrations. The balance attraction between the balance plate 130 and the rotor 150 may reliably assure rotational movements of the rotor 150 relative to the stator 140 and thus eliminate vibrations of the rotor 150 during rotational movements thereof. Preferably, the circuit board 120 and the balance plate 130 are fittingly mounted around the tube seat 112 of the casing 110, and the axle tube 141 of the stator 140 is fittingly mounted in the tube seat 112 of the casing 110.

Figure 5:
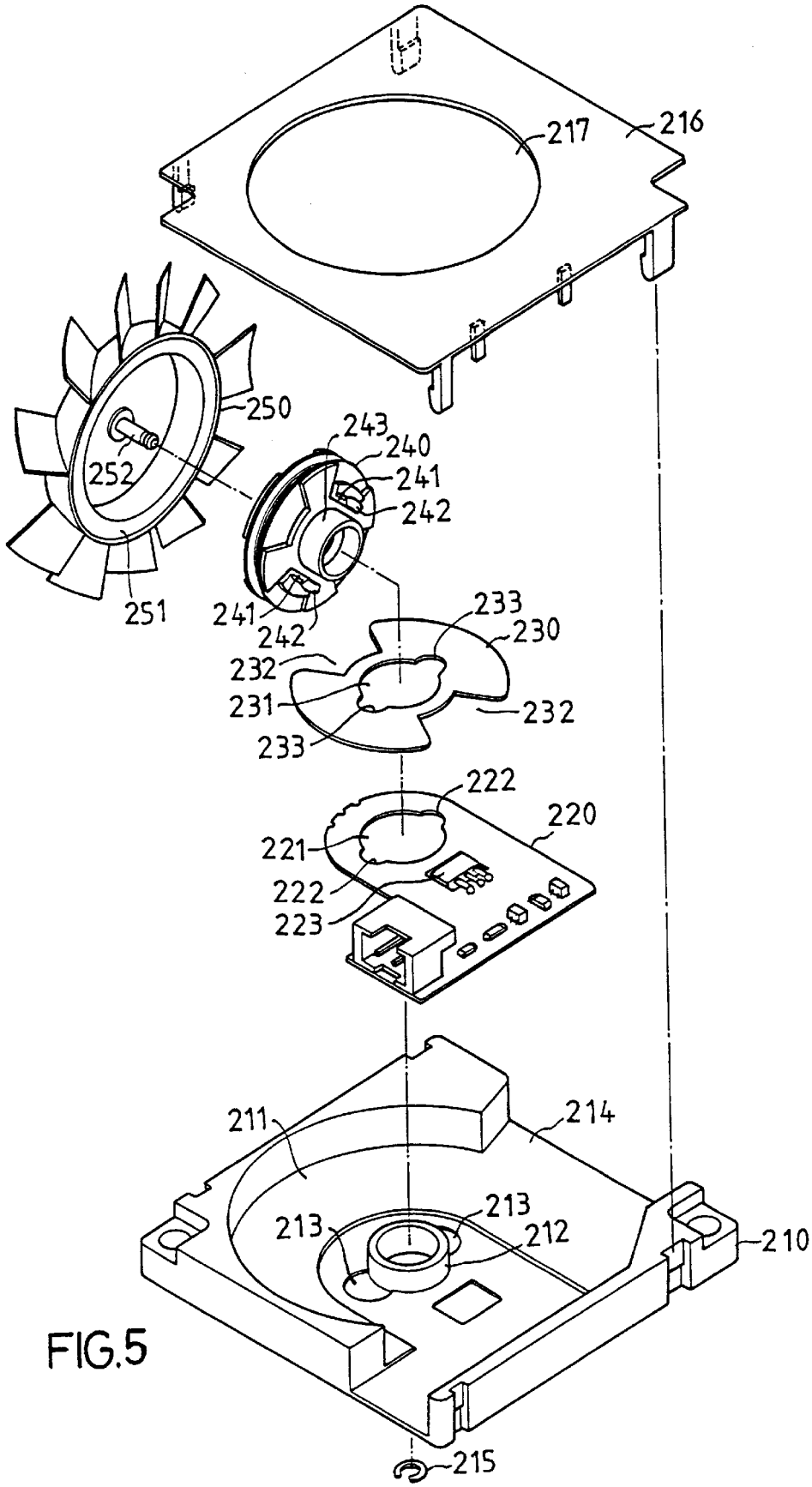
FIG. 5 is an exploded perspective view of a second embodiment of a miniature heat dissipating fan assembly in accordance with the present invention.
Figure 6:
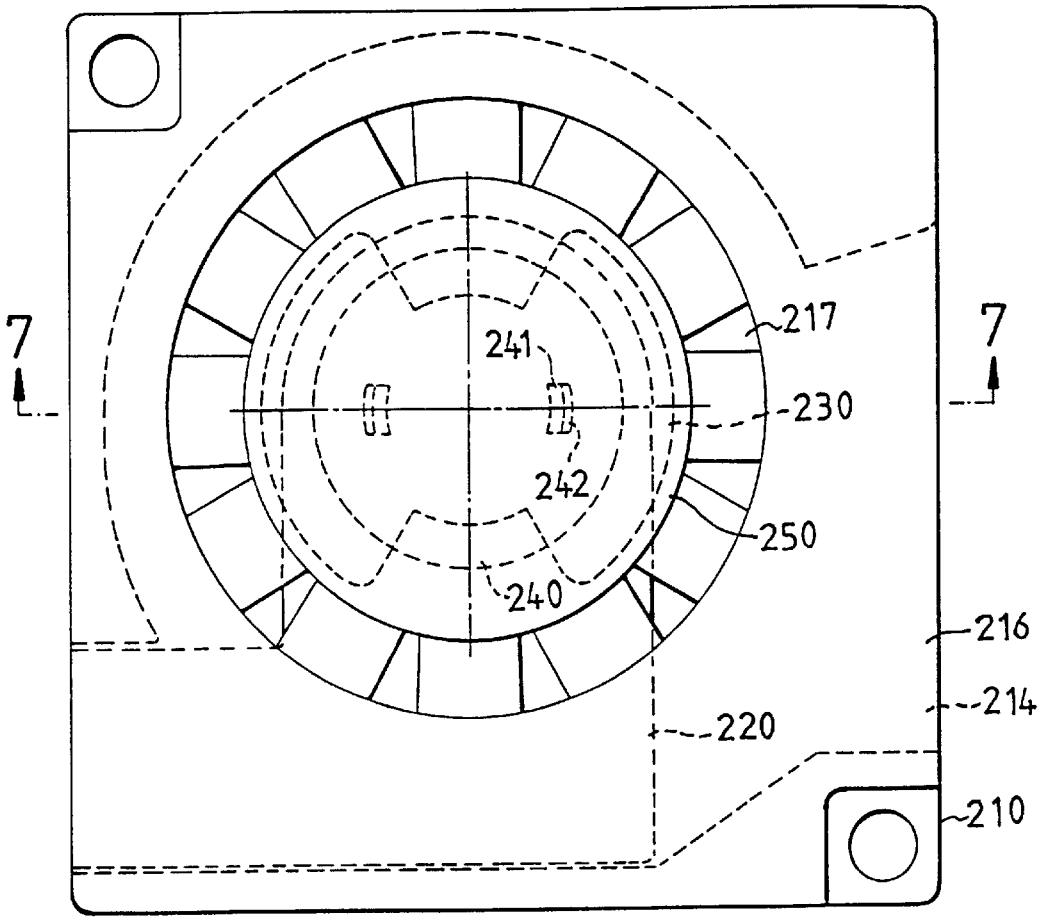
FIG. 6 is a top view of the miniature heat dissipating fan assembly in FIG. 5.
Figure 7:
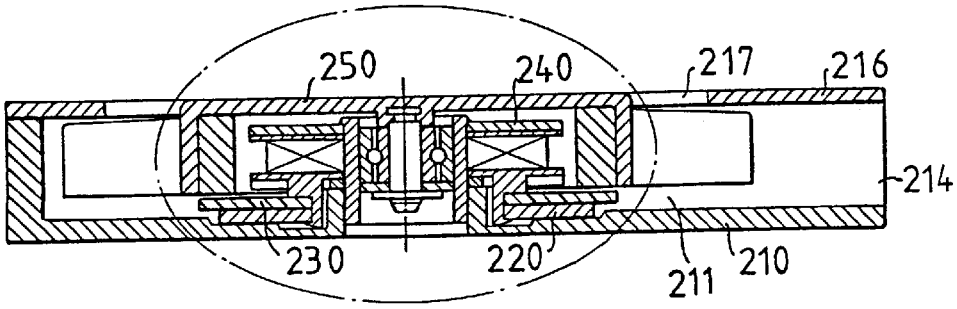
FIG. 7 is a sectional view taken along line 7—7 in FIG. 6.
Figure 8:
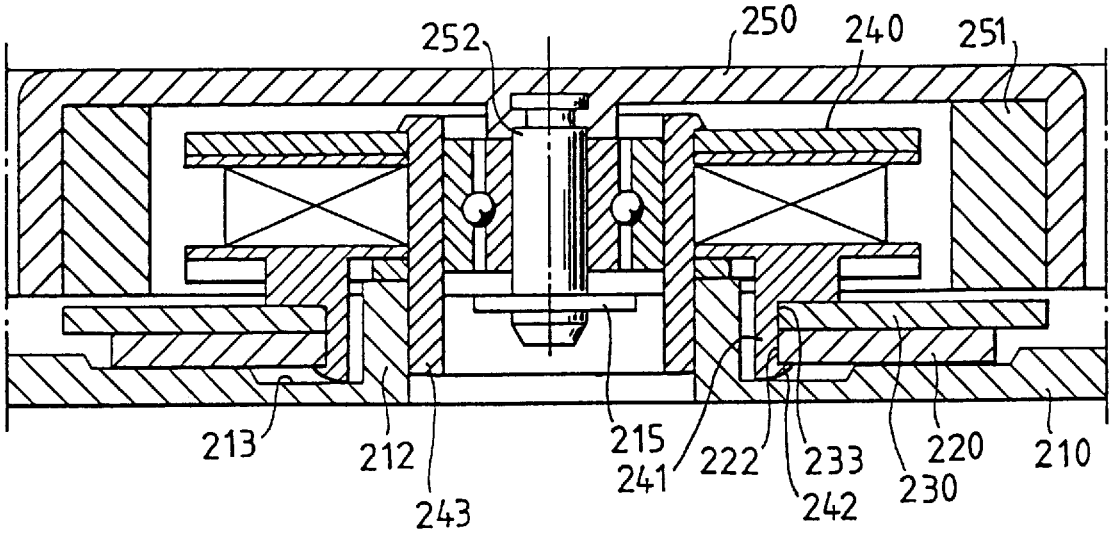
FIG. 8 is an enlarged view of a circle in FIG. 7.

Referring to FIG. 5, a second embodiment of a miniature heat dissipating fan assembly in accordance with the present invention generally includes a casing 210, a circuit board 220, a balance plate 230, a stator 240, a rotor 250, and a cover plate 216. Still referring to FIG. 5, and further to FIGS. 6 to 8, the casing 210 includes a compartment 211 and an air outlet 214 communicated with the compartment 211. A bottom wall that defines the compartment 211 includes a tube seat 212 formed thereon. The bottom wall further includes two recesses 213 symmetrically defined around the tube seat 212. The circuit board 220 includes a fixing hole 221 so as to be mounted around the tube seat 212. An inner periphery that defines the fixing hole 221 has two diametrically disposed recessed sections or positioning notches 222 that respectively align with the recesses 213 when the circuit board 220 is mounted around the tube seat 212. The balance plate 230 is mounted above the circuit board 220 and includes a fixing hole 231 so as to be mounted around the tube seat 212. The balance plate 230 may further include two notches 232 defined in a periphery thereof. A Hall sensor 223 mounted on the circuit board 220 may be received in one of the notches 232. An inner periphery that defines the fixing hole 231 also has two diametrically disposed recessed sections or positioning notches 233 that respectively align with the recesses 213 when the balance plate 230 is mounted around the tube seat 212. The stator 240 includes an axle tube 243 received in the tube seat 212, while the rotor 250 includes an axle 252 rotatably received in the axle tube 243, and a fastening member 215 is provided to a distal end of the axle 252 to retain the axle 252 in place. The stator 240 further includes two diametrically disposed positioning pegs 241 mounted around the axle tube 243 and extended through the notches 233 and 222. As shown in FIG. 8, each positioning peg 241 includes a hook 242 at a distal end thereof that is received in an associated recess 213 of the casing 210 to reliably engage with an underside of the circuit board 220. The rotor 250 further includes a permanent magnet 251 mounted in an inner periphery thereof.

Again, the permanent magnet 251 and the balance plate 230 attract each other to generate a balancing attraction therebetween. This attraction assures stable rotational movements of the rotor 250 relative to the stator 240. The cover plate 216 is attached to the casing 210 and includes an air inlet 217.

In brief, in the second embodiment, the stator 240 includes two positioning pegs 241 each having a hook 242 at a distal end thereof to reliably engage the circuit board 220 and the balance plate 230 to the stator 240. The assembly procedure is simple, and the circuit board 220, the balance plate 230, the stator 240, and the rotor 250 can be positioned.

Figure 9:
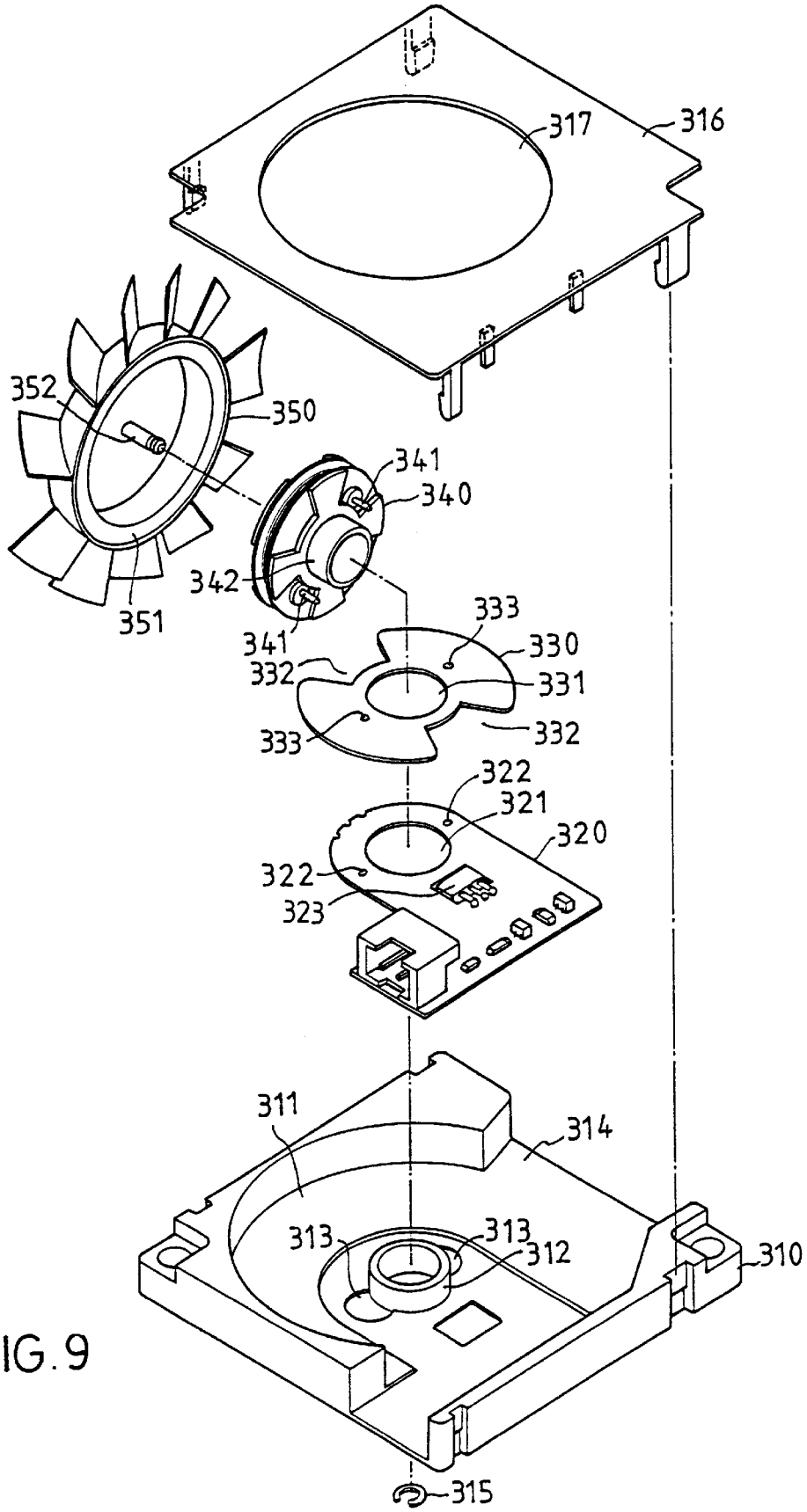
FIG. 9 is an exploded perspective view of a third embodiment of a miniature heat dissipating fan assembly in accordance with the present invention.
Figure 10:
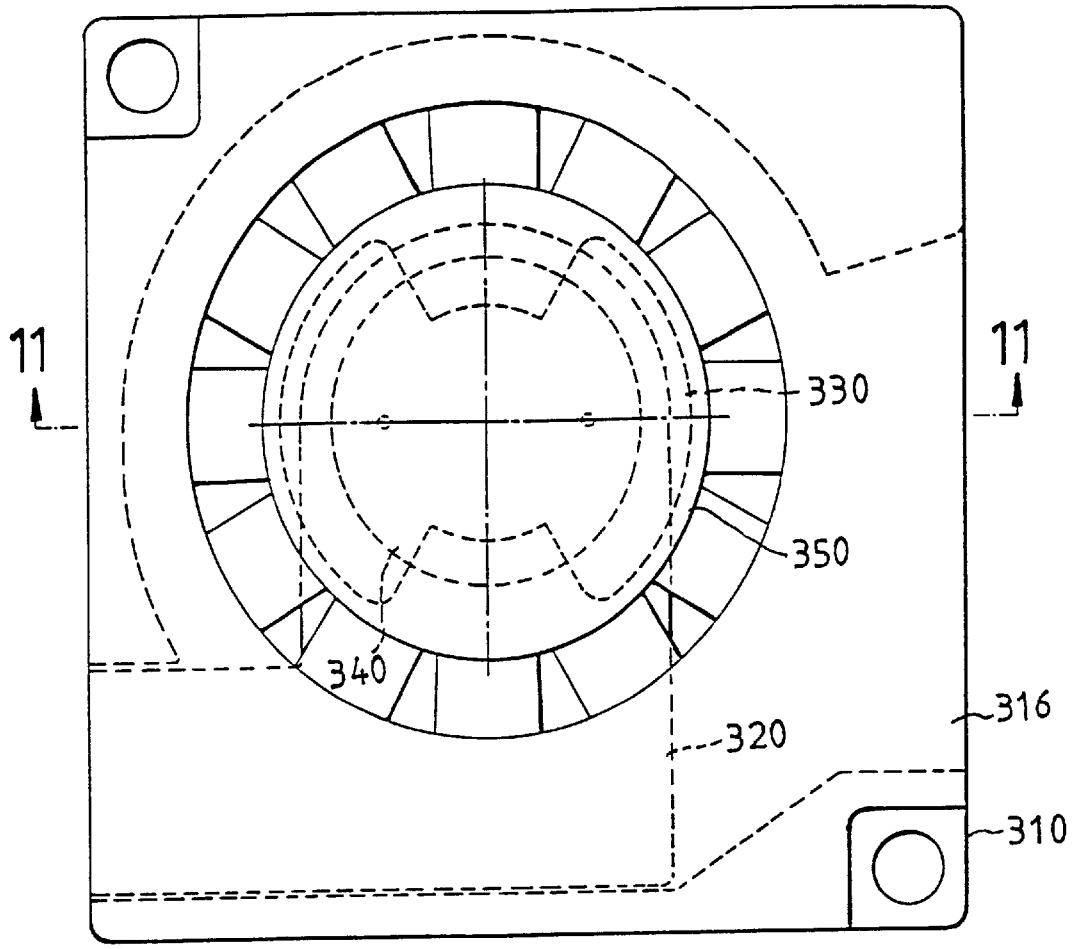
FIG. 10 is a top view of the miniature heat dissipating fan assembly in FIG. 9.
Figure 11:
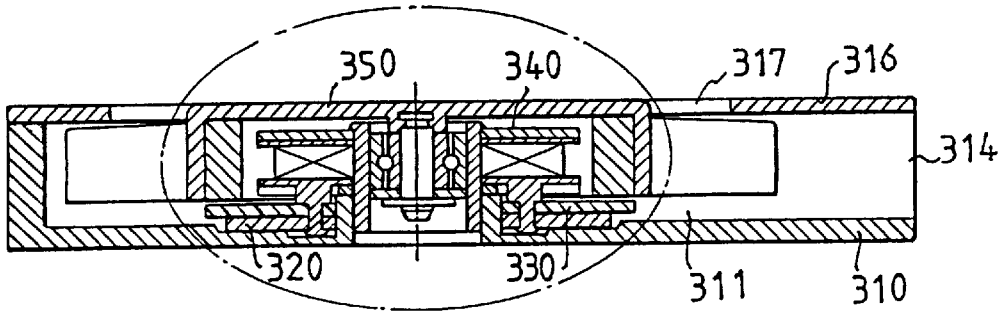
FIG. 11 is a sectional view taken along line 11—11 in FIG. 10.
Figure 12:
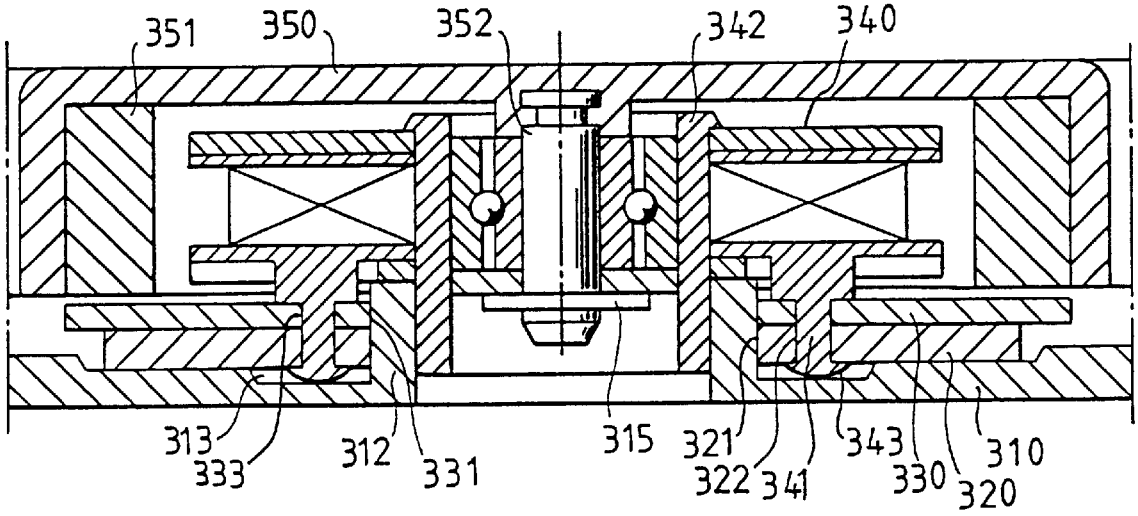
FIG. 12 is an enlarged view of a circle in FIG. 11.

Referring to FIG. 9, a third embodiment of a miniature heat dissipating fan assembly in accordance with the present invention generally includes a casing 310, a circuit board 320, a balance plate 330, a stator 340, a rotor 350, and a cover plate 316. Still referring to FIG. 9, and further to FIGS. 10 to 12, the casing 310 includes a compartment 311 and an air outlet 314 communicated with the compartment 311. A bottom wall that defines the compartment 311 includes a tube seat 312 formed thereon. The bottom wall further includes two recesses 313 symmetrically defined around the tube seat 312. The circuit board 320 includes a fixing hole 321 so as to be mounted around the tube seat 312. Two positioning holes 322 are diametrically disposed around the fixing hole 321 and respectively align with the recesses 313 when the circuit board 320 is mounted around the tube seat 312. The balance plate 330 is mounted above the circuit board 320 and includes a fixing hole 331 so as to be mounted around the tube seat 312. The balance plate 330 may further include two notches 332 defined in a periphery thereof. A Hall sensor 323 mounted on the circuit board 320 may be received in one of the notches 332. Two positioning holes 333 are diametrically disposed around the fixing hole 331 and respectively align with the recesses 313 when the balance plate 330 is mounted around the tube seat 312. The stator 340 includes an axle tube 342 received in the tube seat 312, while the rotor 350 includes an axle 352 rotatably received in the axle tube 342, and a fastening member 315 is provided to a distal end of the axle 352 to retain the axle 352 in place. The stator 340 further includes two diametrically disposed positioning pegs 341 mounted around the axle tube 342 and extended through the positioning holes 333 and 322. As shown in FIG. 12, each positioning peg 341 includes a hook 343 at a distal end thereof that is received in an associated recess 313 of the casing 310 to reliably engage with an underside of the circuit board 320. The hook 343 can be formed by heat pressing after the positioning peg 341 has extended through the associated positioning hole 333 and hole 322. The rotor 350 further includes a permanent magnet 351 mounted in an inner periphery thereof.

Again, the permanent magnet 351 and the balance plate 330 attract each other to generate a balancing attraction therebetween. This attraction assures stable rotational movements of the rotor 350 relative to the stator 340. The cover plate 316 is attached to the casing 310 and includes an air inlet 317.

In brief, in the third embodiment, the stator 340 includes two positioning pegs 341 each having a hook 343 at a distal end thereof to reliably engage the circuit board 320 and the balance plate 330 to the stator 340. The assembly procedure is simple, and the circuit board 320, the balance plate 330, the stator 340, and the rotor 350 can be positioned.

Figure 13:
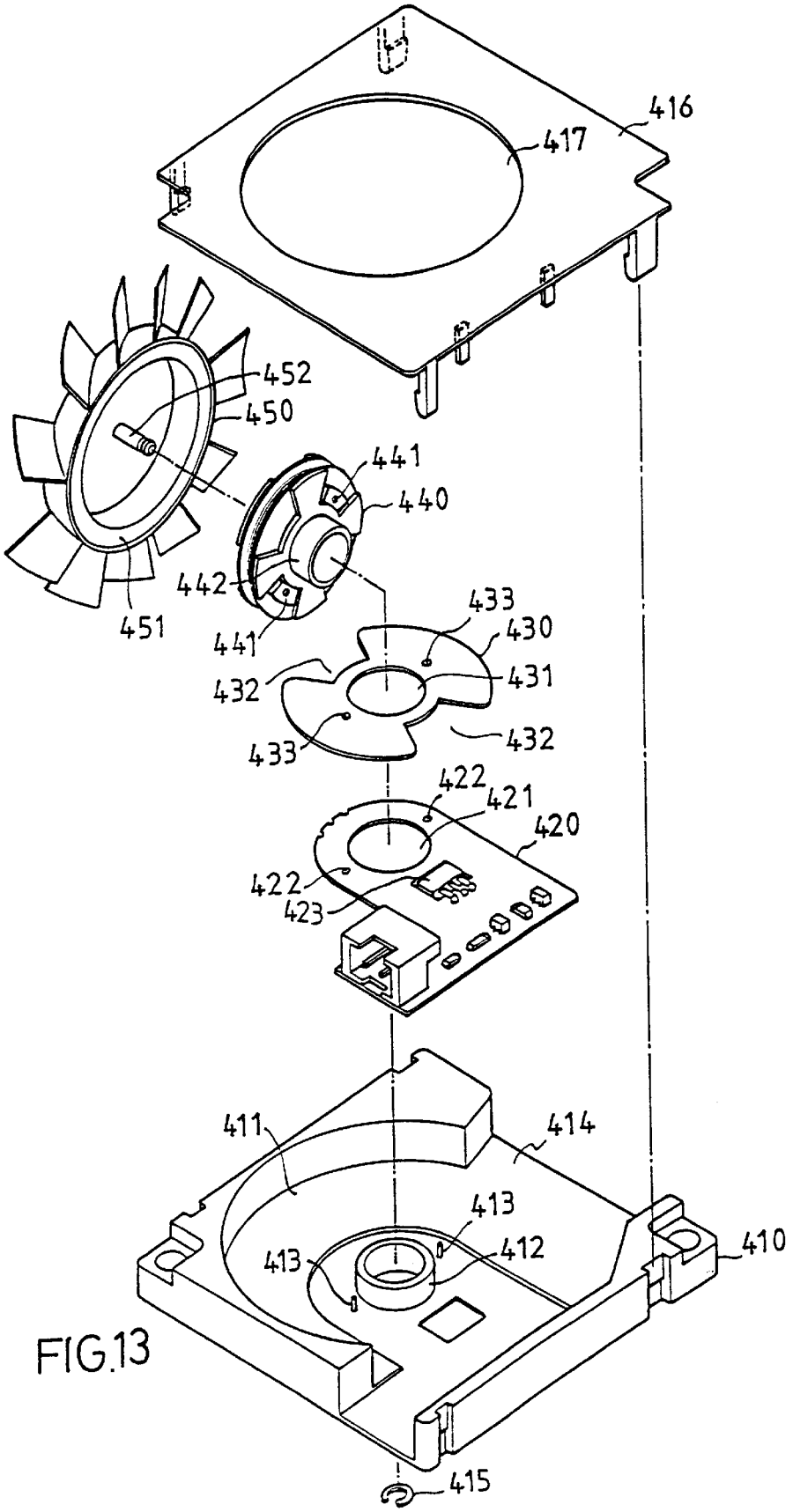
FIG. 13 is an exploded perspective view of a fourth embodiment of a miniature heat dissipating fan assembly in accordance with the present invention.
Figure 14:
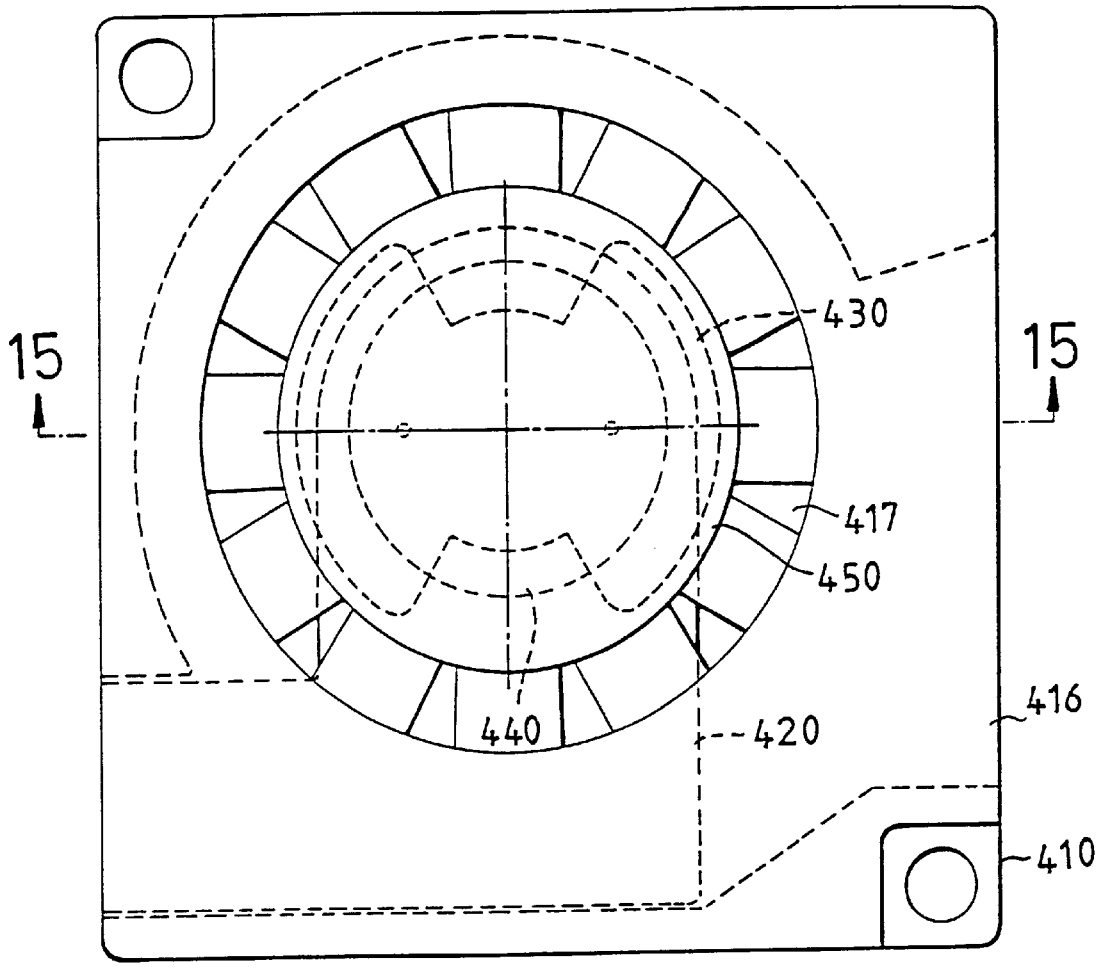
FIG. 14 is a top view of the miniature heat dissipating fan assembly in FIG. 13.
Figure 15:
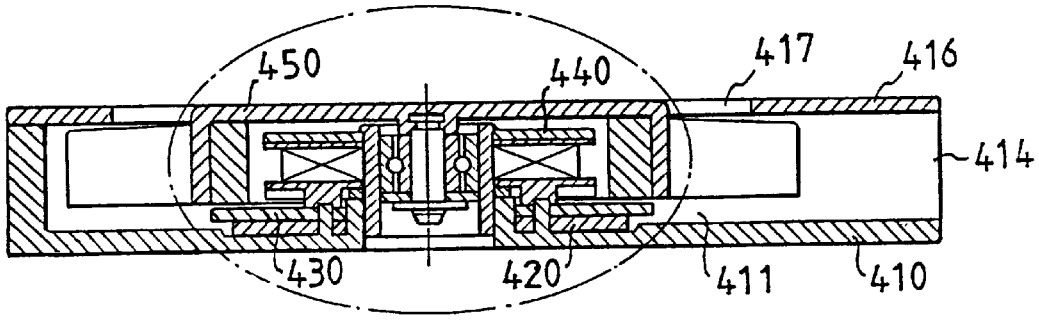
FIG. 15 is a sectional view taken along line 15—15 in FIG. 14.
Figure 16:
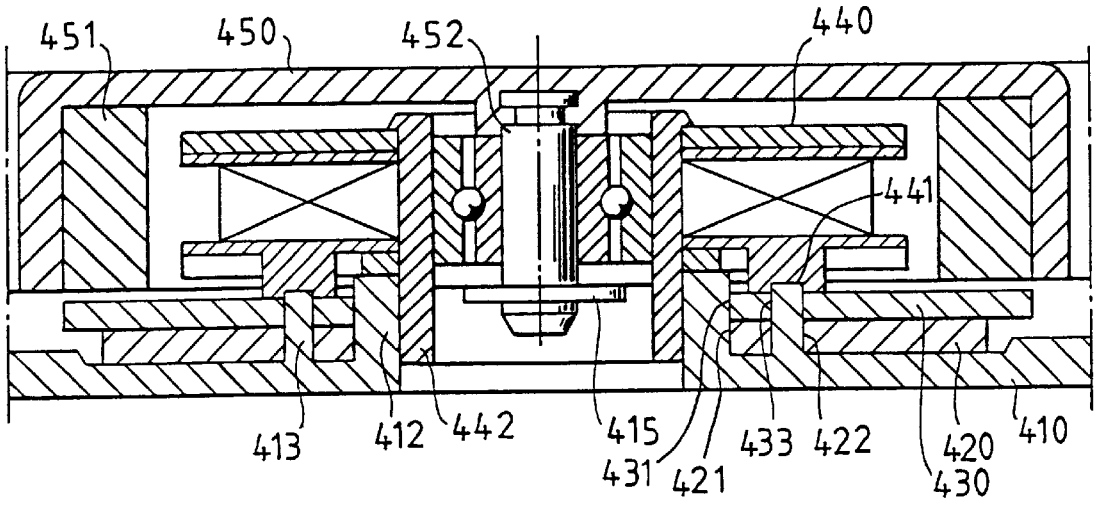
FIG. 16 is an enlarged view of a circle in FIG. 15.

Referring to FIG. 13, a fourth embodiment of a miniature heat dissipating fan assembly in accordance with the present invention generally includes a casing 410, a circuit board 420, a balance plate 430, a stator 440, a rotor 450, and a cover plate 416. Still referring to FIG. 13, and further to FIGS. 14 to 16, the casing 410 includes a compartment 411 and an air outlet 414 communicated with the compartment 411. A bottom wall that defines the compartment 411 includes a tube seat 412 formed thereon. The bottom wall further includes two positioning pegs 413 diametrically formed around the tube seat 412. The circuit board 420 includes a fixing hole 421 so as to be mounted around the tube seat 412. Two positioning holes 422 are diametrically disposed around the fixing hole 421 and respectively extended by the positioning pegs 413 when the circuit board 420 is mounted around the tube seat 412. The balance plate 430 is mounted above the circuit board 420 and includes a fixing hole 431 so as to be mounted around the tube seat 412. The balance plate 430 may further include two notches 432 defined in a periphery thereof. A Hall sensor 423 mounted on the circuit board 420 may be received in one of the notches 432. Two positioning holes 433 are diametrically disposed around the fixing hole 431 and respectively extended by the positioning pegs 413 when the balance plate 430 is mounted around the tube seat 412. The stator 440 includes an axle tube 442 received in the tube seat 412, while the rotor 450 includes an axle 452 rotatably received in the axle tube 442, and a fastening member 415 is provided to a distal end of the axle 452 to retain the axle 452 in place. The stator 440 further includes two diametrically disposed positioning holes 441 defined around the axle tube 442 and respectively extended by the positioning pegs 413. As shown in FIG. 16, each positioning peg 413 is extended through associated positioning holes 422, 433, and 441. The rotor 450 further includes a permanent magnet 451 mounted in an inner periphery thereof.

Again, the permanent magnet 451 and the balance plate 430 attract each other to generate a balancing attraction therebetween. This attraction assures stable rotational movements of the rotor 450 relative to the stator 440. The cover plate 416 is attached to the casing 410 and includes an air inlet 417.

In brief, in the third embodiment, the casing 410 includes two positioning pegs 413 to reliably engage the circuit board 420, the balance plate 430, and the stator 440 to the casing 410. The assembly procedure is simple, and the circuit board 420, the balance plate 430, the stator 440, the rotor 450, and the casing 410 can be positioned.

Conclusively, the present invention discloses a balance plate 130 mounted around the tube seat 112 (FIG. 1), a balance plate 230 with two positioning notches 233 extended by positioning pegs 241 of the stator 240 (FIG. 5), a balance plate 330 with two positioning holes 333 extended by positioning pegs 341 of the stator 340 (FIG. 9), and a balance plate 430 with two positioning holes 433 extended by positioning pegs 413 of the casing 410 (FIG. 13). All arrangements of the embodiments allow easy assembly and secure positioning effects among the elements.

Although the invention has been explained in relation to its preferred embodiment, it is to be understood that many other possible modifications and variations can be made without departing from the spirit and scope of the invention as hereinafter claimed.

What is claimed is:

1. A miniature heat dissipating fan assembly, comprising:

a casing including a compartment, a bottom wall defining the compartment having a tube seat formed thereon;

a circuit board mounted in the compartment of the casing;

a balance plate mounted above the circuit board;

a stator including an axle tube mounted in the tube seat; and a rotor including a permanent magnet and an axle that is rotatably mounted in the axle tube of the stator;

wherein the balance plate and the permanent magnet generate an attraction therebetween.

2. The miniature heat dissipating fan assembly as claimed in claim 1, wherein the circuit board includes a fixing hole extended by the tube seat of the casing.

3. The miniature heat dissipating fan assembly as claimed in claim 1, wherein the balance plate includes a fixing hole extended by the tube seat of the casing.

4. The miniature heat dissipating fan assembly as claimed in claim 1, wherein the balance plate includes two symmetrically disposed notches, and the circuit board includes a Hall sensor received in one of the notches.

5. The miniature heat dissipating fan assembly as claimed in claim 1, wherein the circuit board and the balance plate are fittingly mounted around the tube seat of the casing, and wherein the axle tube of the stator is fittingly mounted in the tube seat of the casing.

6. The miniature heat dissipating fan assembly as claimed in claim 1, wherein the balance plate includes at least one positioning notch, and wherein the stator includes at least one positioning peg extended through said at least one positioning notch.

7. The miniature heat dissipating fan assembly as claimed in claim 6, wherein said at least one positioning peg includes a hook at a distal end thereof.

8. The miniature heat dissipating fan assembly as claimed in claim 1, wherein the balance plate includes at least one positioning hole, and wherein the stator includes at least one positioning peg extended through said at least one positioning hole.

9. The miniature heat dissipating fan assembly as claimed in claim 8, wherein said at least one positioning peg includes a hook at a distal end thereof the hook being formed by heat pressing.

10. The miniature heat dissipating fan assembly as claimed in claim 1, wherein the balance plate includes at least one positioning hole, and wherein the casing includes at least one positioning peg extended through said at least one positioning hole.

11. A miniature heat dissipating fan assembly, comprising:

a balance plate including a fixing hole and at least one positioning hole;

a stator including an axle tube mounted in the fixing hole of the balance plate and at least one positioning peg extended through said at least one positioning hole of the balance plate; and a rotor including a permanent magnet and an axle that is rotatably mounted in the axle tube of the stator;

wherein the balance plate and the permanent magnet generate an attraction therebetween.

12. The miniature heat dissipating fan assembly as claimed in claim 11, wherein the balance plate includes two symmetrically disposed notches.

13. The miniature heat dissipating fan assembly as claimed in claim 11, wherein said at least one positioning peg includes a hook at a distal end thereof.

14. The miniature heat dissipating fan assembly as claimed in claim 11, wherein said balance plate has an extreme edge wider than an area which the inner edge of said permanent magnet defines.

15. The miniature heat dissipating fan assembly as claimed in claim 11, wherein said balance plate is mounted around the side of said permanent magnet.

16. The miniature heat dissipating fan assembly as claimed in claim 11, wherein there is provided a gap which is defined between said balance plate and said permanent magnet.

* * * * *